United States Patent [19]

Ikeda

[11] Patent Number: 4,908,934

[45] Date of Patent: Mar. 20, 1990

[54] PROCESS OF PRODUCING A FOIL-ROLL ELECTRONIC PART

[76] Inventor: Takeshi Ikeda, 5-6-213 Sanno-2, Ohta-Ku, Tokyo 143, Japan

[21] Appl. No.: 309,843

[22] Filed: Feb. 13, 1989

Related U.S. Application Data

[62] Division of Ser. No. 144,874, Jan. 13, 1988.

[30] Foreign Application Priority Data

Jan. 14, 1987 [JP] Japan ..... 62-004967

[51] Int. Cl.[4] ..... H01R 43/00

[52] U.S. Cl. ..... 29/827; 29/25.42; 29/605; 242/7.11; 242/7.03

[58] Field of Search ..... 29/827, 605, 25.42; 242/7.02, 7.03, 7.07, 7.08, 7.11, 7.13

[56] References Cited

U.S. PATENT DOCUMENTS 3,153,180 10/1964 Bellmore ..... 29/829
3,539,886 11/1970 Kellerman ..... 29/25.42
3,771,086 11/1973 Poulsen ..... 29/605
4,166,285 8/1979 Bauer et al. ..... 29/25.42

*Primary Examiner*—P. W. Echols
*Attorney, Agent, or Firm*—Allston L. Jones

[57] ABSTRACT

A foil-roll electronic part and a process of producing the same. The part produced in this process includes: a lead frame having a plurality of leads; at least a belt-shaped conductive foil connected at one end or thereabout to a given lead of the lead frame and connected at the other end or thereabout or the intermediate portion thereof to the other lead; and at least two insulating films interposed between the belt-shaped conductive foils; whereby the electric part is formed by rolling the belt-shaped conductive foils and the insulating films on the lead frame as being a spool. According to this invention, the foil-roll electronic part wherein lead intervals can be accurately positioned, the production thereof is suitable for the bulk production, the electronic part is excellent in electric characteristics and easily, actually mounted on a printed circuit board.

2 Claims, 8 Drawing Sheets

PROCESS OF PRODUCING A FOIL-ROLL ELECTRONIC PART

CROSS REFERENCE TO RELATED APPLICATION

This is a division of application Ser. No. 144,874, filed Jan. 13, 1988.

BACKGROUND OF THE INVENTION

1. Field of the Invention

This invention relates to a foil-roll electronic part and a process of producing the same, and more particularly to a foil-roll electronic part formed by rolling in a belt-shaped conductive foil or foils and a process of producing the same.

2. Description of the Prior Art

The inventor of the present invention has proposed a foil-roll electronic part wherein one or a plurality of belt-shaped conductive foils made of aluminum or copper are rolled on a magnetic or non-magnetic spool, or rolled on no core through insulating films of a high dielectric constant such as Mylar and polyethylene. This electronic part has an inductance wherein a stray capacitance is distributed over the total length of the belt-shaped conductor or conductors which has been rolled in or between the respective belt-shaped conductive foils. Owing to this characteristic, this electronic part can be used in the various fields as LC composite parts including a coil, a noise filter and a transformer.

This foil-roll electronic part utilizes a belt-shaped conductive foil or foils. Owing to this, an electric current of a relatively high value can be passed therethrough, a skin effect to a high frequency signal is minimal, the electronic part is compact in size, and yet, a high inductance and capacitance can be obtained, and the workability is satisfactory. Due to the above-described reasons, this foil-roll electronic part has a possibility of being widely used for the various applications, and particularly, it is ascertained by the inventor that, in the noise filter, an outstanding attenuation characteristic can be obtained.

Various noise filters using the belt-shaped conductive foil or foils are described above have been proposed by the inventor of the present invention.

As shown in FIG. 11(A) for example, two insulating films 10*a* and 10*b* which is formed of Mylar tapes and two of belt-shaped conductive foils 12*a* and 12*b* which are formed of aluminum foils are alternately superposed on each other and rolled into a tubular shape. At this time, leads 14*a* and 14*c* are connected by electric welding or the like to a roll starting portion and a roll terminating portion of one 12*a* of the belt-shaped conductive foils, which is used as a conductor for passing electricity. Furthermore, a lead 14*b* for grounding is connected by the same method as above to one end portion, preferably a roll starting portion of the other 12*b* of the belt-shaped conductive foils, which is used for a grounding conductor.

In the noise filter formed as described above, an inductance is formed between the leads 14*a* and 14*c* of the belt-shaped conductive foil 12*a* for passing the electricity, and yet, a capacitance is formed in the manner of a distributed constant between the belt-shaped conductive foil 12*c* for grounding and the belt-shaped conductive foil 12*a* for passing the electricity over the total length of the conductor 12*a*. FIG. 11(B) shows an equivalent circuit diagram of the noise filter thus formed.

Accordingly, when the lead 14*b* for grounding is grounded and the leads 14*a* and 14*c* of the belt-shaped conductive foil 12*a* are used as input and output terminals, respectively, a noise filter having outstanding attenuation characteristics over a wide frequency band can be obtained.

Now, in the noise filter of the type described, it is required that the three leads 14*a*, 14*b* and 14*c* are arranged on a straight line at regular intervals as shown in FIG. 12(A).

If these leads 14*a*, 14*b* and 14*c* are arranged irregularly, then, particularly, the uniform attenuation characteristics and outstanding electric characteristics as in the noise filter cannot be obtained.

Further, these leads 14*a*, 14*b* and 14*c* should be arranged on the straight line at regular intervals, and yet, the lead arrangement should meet a hole pitch of a printed circuit board for being actually mounted thereon.

If this lead arrangement does not meet the hole pitch of the printed circuit board, then, the respective leads 14*a*, 14*b* and 14*c* cannot be inserted into the holes of the printed circuit board to mount the noise filter.

Normally, the foil-roll electronic part of the type described can be manufactured by use of a device analogous to a device for producing a paper capacitor.

However, if the above-described device is used, then, due to the values of the rollings being tightened in the condition of loosely rolled-up rollings at the time of roll-up, the arrangement of the three leads 14*a*, 14*b* and 14*c* is not definite and the respective leads tend to be shifted from one another as shown in FIGS. 12(B) and 12(C). Because of this, it has been extremely difficult to roll up such that the respective leads are regularly arranged at all times.

Moreover, such problems have been pressurized that, after the roll-up, the irregularly arranged leads 14*a*, 14*b* and 14*c* should be corrected to have a regular pitch, whereby the producitivity is low and the production thereof is not suitable for bulk production.

SUMMARY OF THE INVENTION

The present invention has been developed to obviate the problems in the manufacture of the above-described foil-roll electronic part and has as its object the provision of a foil-roll electronic part which can be accurately positioned at lead intervals, is suitable for bulk production, has excellent electric characteristics and can be easily, actually mounted on a printed circuit board, and a process of producing the same.

To achieve the above-described object, the present invention contemplates in a foil-roll electronic part including: a lead frame having a plurality of leads; at least a belt-shaped conductive foil, one end or thereabout of which is connected to a given lead of this lead frame and the other end or thereabout or the intermediate portion of which is connected to the other lead; and at least two insulating films interposed between the respective belt-shaped conductive foils; whereby the belt-shaped conductive foils and the insulating films are rolled in with the lead frame being used as a spool, to thereby form the foil-roll electronic part.

The process according to the present invention is the one of producing a foil-roll electronic part having at least three leads, features inclusion of the steps of:

forming a lead frame having at least three leads connected at the ends on one side to connecting members;

connecting one end of the belt-shaped conductive foil to at least one lead of the lead frame and engaging the respective leads of this lead frame with a regulating member;

rolling the belt-shaped conductive foils on the regulating member as being a spool through the insulating films;

bending and connecting an extension formed on the other lead to the roll terminating portion or the intermediate portion of the belt-shaped conductive foil; and cutting off connected portions of the respective leads.

Furthermore, the process according to the present invention is the one of producing the foil-roll electronic part having at least three leads, and features inclusion of the steps of:

forming a lead frame having at least two first leads, which are connected at least at ends on one side thereof to connecting members, and at least one second lead connected only at one end thereof to a connecting member;

connecting one end of a belt-shaped conductive foil to at least one of the first leads and bending the second lead through a predetermined angle;

rolling the belt-shaped conductive foil on the first lead as being a spool through insulating films, returning the bent second lead to the substantially original position and connecting the second lead to the roll terminating position or the intermediate portion of the belt-shaped conductive foil; and cutting off connected portions of the respective leads.

DETAILED DESCRIPTION OF THE PREFERRED EMBODIMENTS

The preferred embodiments of the present invention will hereunder be described with reference to the accompanying drawings.

The first embodiment

Figure 1A:
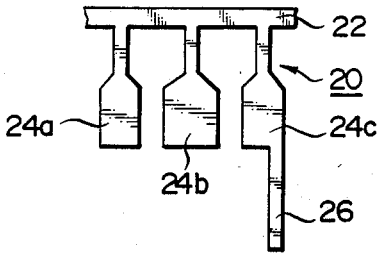
FIG. 1 is an explanatory view showing the noise filter according to the present invention in the order of the steps of manufacturing.
Figure 1:
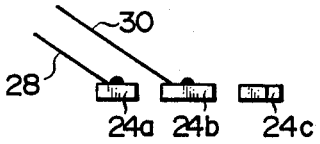
Figure 1:
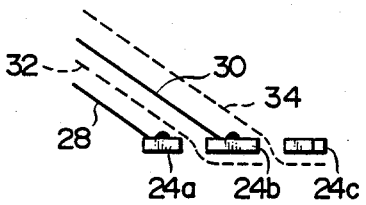

FIGS. 1 show a preferred example of a distributed constant type noise filter according to the present invention. FIGS. 1(A)–1(J) illustrating steps in the manufacture of the noise filter.

FIG. 1(A) shows a lead frame 20 used in this embodiment. This lead frame 20 has at least three spade-shaped leads 24*a*, 24*b* and 24*c*, which are previously formed at regular intervals. In this embodiment, the lead frame is formed similarly to the lead frame used in packaging a semiconductor integrated circuit (IC). In this lead frame 20, the three leads 24*a*, 24*b* and 24*c*, which are generally parallel to one another, are connected at one end to one another through a connecting member 22.

Normally, the lead frame 20 of this type is formed by pressing a copper or a nickel alloy plate. Furthermore, this lead frame 20 as a whole is preferably plated by use of a solder or a highly conductive metal.

Referring to the drawing, in this lead frame 20, a bendable extension 26 is formed at one end of the lead 24*c*.

In this embodiment, by use of the lead frame 20 thus formed, first, a step shown in FIG. 1(B) is performed. In this step, a belt-shaped conductive foil 28, for passing electricity, and the belt-shaped conductive foil 30, for grounding, are connected to the respective leads 24*a* and 24*b*. In this embodiment, first, a starting end of the belt-shaped conductive foil 28, to be a conductor for passing electricity, is welded to the lead 24*a*. Similarly, the starting end of the belt-shaped conductive foil 30, to be a conductor for grounding, is welded to the lead 24*b*.

Subsquently, a step down in FIG. 1(C) is performed. In this step, insulating films 32 and 34, formed of capacitor papers or Mylar tapes, are interposed between the respective belt-shaped conductive foils 28 and 30.

Figure 1D:
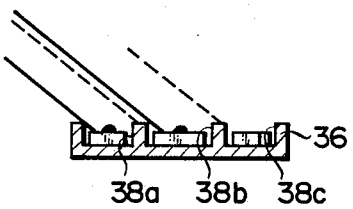

Next, a step shown in FIG. 1(D) is performed. In this step, a regulating member 36 for holding the respective leads 24*a*–24*c* at regular intervals is prepared. Then, the respective leads 24*a*–24*c* are coupled into grooves 38*a*–38*c* of this regulating member 36. The depth of the grooves 38 is determined to be slightly larger than the thickness of the leads 24*a*–*c*.

Figure 1E:
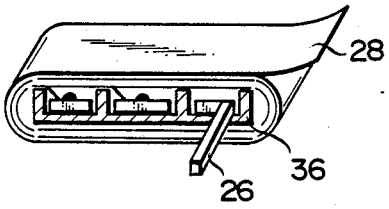

Subsequently, a rolling step shown in FIG. 1(E) is performed. In this step, by use of the lead frame 20 coupled thereinto with a regulating member 36 as a spool, the belt-shaped conductive foils 28 and 30 are alternately superimposed on each other with the insulating films thereinbetween and rolled by a predetermined number of times into a tubular shape with the conductive foils being held flat. At this time, the belt-shaped conductive foils 28 and 30 are rolled around the spool the number of times necessary to achieve the desired values of inductance and capacitance.

Figure 1F:
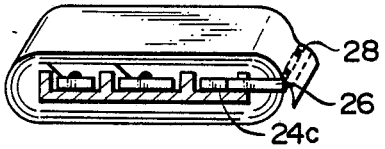

Next, a step of treating a terminating end of the belt-shaped conductive foil 28 for passing the electricity as shown in FIG. 1(F) is performed. In this step, the extension 26 of the lead 24c is bent and connected by welding or the like to the terminating end of the belt-shaped conductive foil 28, which has been rolled the predetermined number of times in the step shown in FIG. 1(E).

Figure 1G:
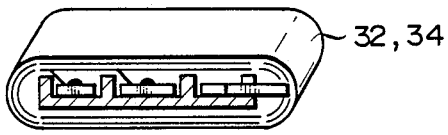

Subsequently, a step of protectively covering as shown in FIG. 1(G) is performed. In this step, the insulating films 32 and 34 are further rolled on to the spool by a predetermined number of times to form a protective covering on the outermost peripheral portion.

Figure 1H:
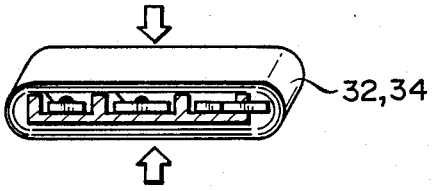

Next, a step of pressing as shown in FIG. 1(H) is performed. This step is the step of pressing the assembly for obtaining uniform characteristics. In this step the rolled-in body is heated and then pressed.

Figure 1I:
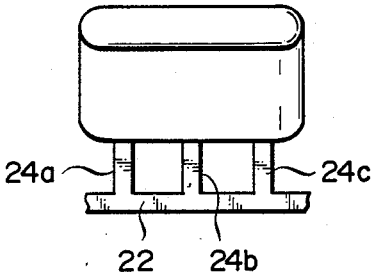

Subsequently, in a step shown in FIG. 1(I), a surface coating of epoxy resin or the like is applied to seal the filter.

Figure 1J:
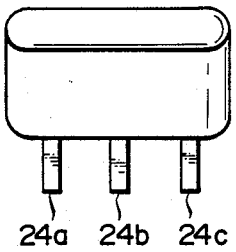

Next, the connecting member 22 is cut off as shown in FIG. 1(J). In this step, the leads 24a–24c are also trimmed. More specifically, the respective leads 24a–24c are cut free of the connecting member 22 of the lead frame 20. With this operation, a finished noise filter is obtained.

As has been described hereinabove, in the noise filter in this embodiment, the lead frame 20, in which the leads 24a–24c are not changed in position, is used, so that the leads 24a–24c can be positioned accurately. Accordingly, it is not necessary to perform the lead position correcting treatment as in the conventional cases where the leads 14a–14c were used, and the respective leads 24a–24c can be arranged in a straight line and at the scheduled intervals. Accordingly, the present invention is suitable for the bulk production of the various foil-rolled electronic parts such as the noise filters, and yet, the yield, the loss of which is caused by the positioning of leads 24, can be improved greatly.

Figure 2:
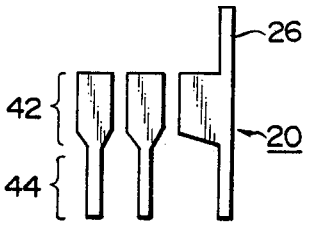
FIGS. 2 and 3 are explanatory views showing examples of modifications of the lead frame used in the present invention.

Further, the noise filter according to the present invention includes the lead frame, so that a portion 42 functions as a spool can be selected to be a desirable shape, with a portion 44 to be the leads of the lead frame being constant in pitch as shown in FIG. 2. With this arrangement, the flatness of the noise filter can be freely selected, meeting the desired characteristics (capacitance and inductance).

Furthermore, in the present invention, as the regulating member 36, a plastic molded insulating holder may be used, for example. As the material for the regulating member 36, an insulating magnetic substance such as ferrite may be used and a magnetic material obtained by sintering magnetic particles together with a binder may be used. When the magnetic regulating member 36 is formed as described above, the belt-shaped conductive foil 28 for passing the electricity is increased in inductance, so that the noise arresting effect is improved, and, in the case of the same value of inductance, the noise filter can be rendered compact in size.

Further, when a magnetic conductor such as iron is used as the belt-shaped conductive foil, the inductance in a rolled coil is increased, so that the noise arresting effect can be improved.

Figure 3:
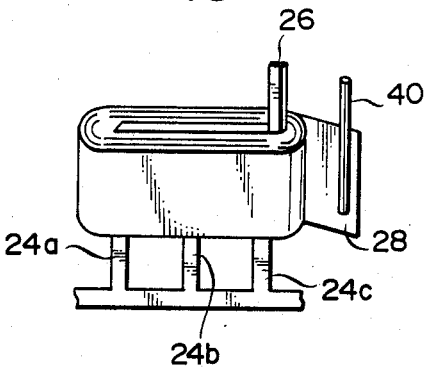

FIG. 3 shows another example of the noise filter according to the present invention.

In this embodiment, an additional lead 40 is previously welded to the proximity of the terminating end of the belt-shaped conductive foil 28 for passing the electricity. Upon completion of the rolling step, this additional lead 40 and the extension 26 of the lead 24c are connected to each other by welding or soldering.

Furthermore, FIG. 4 shows other examples of the regulating member 36 and the lead frame 20.

In this embodiment, the terminating end of the belt-shaped conductive foil 28 for passing the electricity and the lead 24c are connected to each other without using the aforesaid extension 26.

Figure 4A:
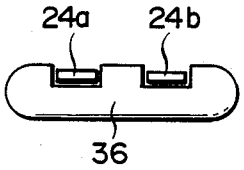
FIGS. 4 are explanatory views of another examples of the noise filter according to the present invention, FIG. 4(A) being an explanatory view showing the regulating member portion, FIG. 4(B) being an explanatory view showing the lead frame portion and FIG. 4(C) being an explanatory view showing an example of a modification of the lead frame portion.
Figure 4B:
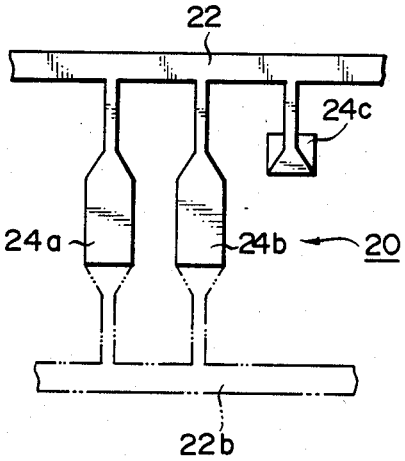

More specifically, in this embodiment, the lead frame 20 shown in FIG. 4(B) is prepared. In the step shown in FIG. 1(C), the lead 24c is previously bent through a suitable angle (90° for example) as compared with the other leads 24a and 24b, and the leads 24a and 24b of the lead frame 20 are coupled into the grooves 38 of the regulating member 36 (Since the lead 24c is bent, in the regulating member 36 used in this embodiment is formed with the grooves only for leads 24a and 24b as shown in FIG. 4(A).

After the belt-shaped conductive foils 28 and 30 and the insulating films 32 and 34 are rolled, in the step shown in FIG. 1(F), the bent lead 24c is returned to the substantially original position and connected to the terminating end of the belt-shaped conductive foil 28 for passing the electricity.

As described above, the leads 24a, 24b and 24c can be lead-arranged generally on a straight line.

Furthermore, when the lead frame 20 shown in FIG. 4(B) is used, the noise filter can be formed without using the regulating member 36. In this caase, as shown in FIG. 4(B), it is preferable that both end portions of the leads 24a and 24b are connected to each other through the connecting members 22 and 22b, so that, even if external forces are applied to the leads 24a and 24b, these leads 24a and 24b can remain undeformed. Additionally, the lead 24c, which is bent for use, is connected only at one end thereof to the other leads 24a and 24b through the connecting member 22.

To form the noise filter by use of the leads 24 thus formed, for example, the lead 24c is bent through the predetermined angle in the step shown in FIG. 1(C), and thereafter, the belt-shaped conductive foils 28, 30 and the insulating films 32, 34 are rolled as shown in FIG. 1(E). Since both ends of the leads 24a and 24b are connected to each other, even if a force is applied thereto more or less during the rolling work, these leads can remain undeformed. Upon completion of this rolling step, the bent lead 24c is returned to the original position and connected to the terminating end of the belt-shaped conductive foil 28.

With this arrangement, the noise filter can be formed without using the regulating member 36, so that the cost of the noise filter per unit can be greatly reduced, and moreover, the thickness of the noise filter can be decreased by approximately the thickness of the regulating member less the thickness of lead frame 20.

Figure 4C:
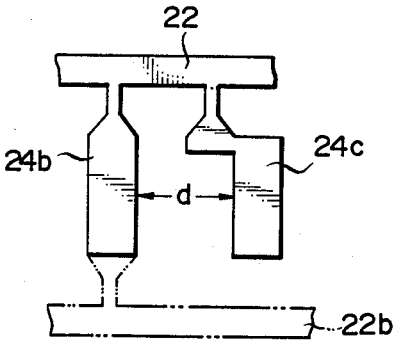

Furthermore, in order to bend the lead 24c as described above to form the noise filter, it is necessary to set a pitch interval d between the lead 24c and the lead 24b adjacent thereto at a suitable value in accordance with the number of turns of the belt-shaped conductive foils 28 and 30. In this case, as shown in FIG. 4(C), the lead 24c is curvedly formed, so that the pitch interval d from the lead 24b adjacent thereto can be set at a desirable value.

Figure 5:
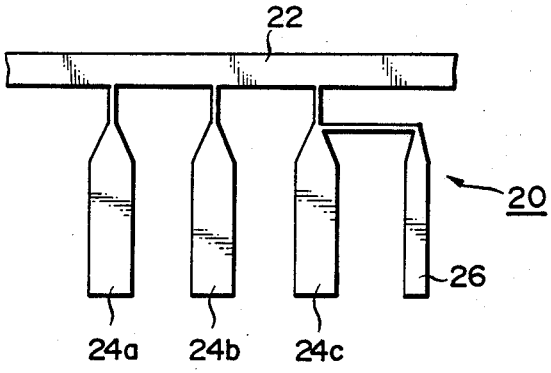
FIG. 5 is an explanatory view showing another example of the lead frame portion.

Furthermore, in this embodiment, the case where the extension 26 is provided at end portions on one end of the leads 24 is exemplified, however, the present invention need not necessarily be limited to this, the above-described extension 26 may be provided in parallel to the leads as shown in FIG. 5. In this case, the extension 26 for connecting to the terminating end of the belt-shaped conductive foil is previously bent through a suitable angle (90° for example) as compared with the leads 24, for example. And, upon rolling of the conductive foils and the insulating time, the extension 26 is returned to the substantially original position and connected to the conductor.

The second embodiment

Figure 6A:
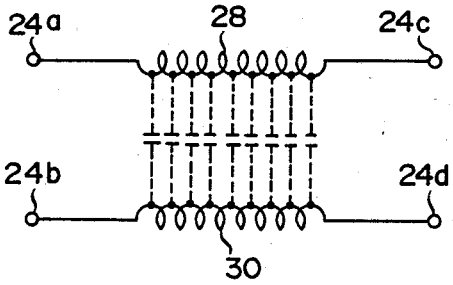
FIGS. 6 A and B are explanatory views of a balanced type noise filter according to the present invention, FIG. 6(A) being the equivalent circuit diagram and FIG. 6(B) being an explanatory view of the regulating member.
Figure 6B:
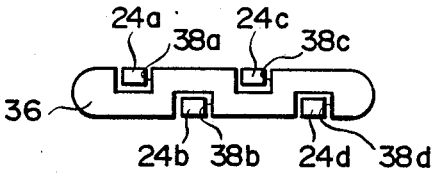

FIGS. 6 A and B show an example of the balance type noise filter according to the present invention, FIG. 6(A) showing the equivalent circuit diagram of this balance type noise filter and FIG. 6(B) showing the regulating member 36 for the leads.

The noise filter in this embodiment is constructed such that the leads 24a, 24b, 24c and 24d are connected to the starting ends and the terminating ends of the two belt-shaped conductive foils 28 and 30.

The leads 24a–24d may be coupled into grooves formed on one side surface of the regulating member 36. Furthermore, as shown in FIG. 6(B), the grooves 38 are formed on opposite side surfaces of the regulating member 36, the leads 24a and 24c of one foil 28 of the belt-shaped conductive foils may be coupled into grooves 38a and 38c, which are formed on one of the side surfaces, and the leads 24b and 24d of the other foil 30 of the belt-shaped conductive foils may be coupled into grooves 38b and 38d, which are formed on the other of the side surfaces. Additionally, the extensions 26 shown in FIG. 1(A) are provided on the leads 24c and 24d.

The third embodiment

FIGS. 7 show an example of the split grounding type noise filter according to the present invention.

Figure 7A:
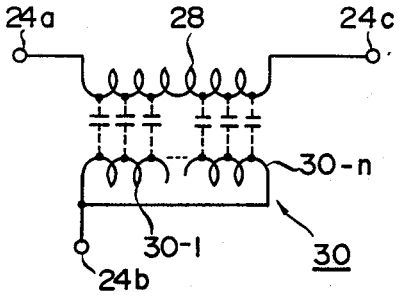
FIGS. 7 A and B are explanatory views of a split grounding type noise filter according to the present invention, FIG. 7(A) being the equivalent circuit diagram and FIG. 7(B) being an explanatory view of the lead frame.

The noise filter in this embodiment is so formed as to have the equivalent circuit diagram shown in FIG. 7(A). More specifically, in this embodiment, the belt-shaped conductive foil 30 for grounding is n-divided into 30-1 . . . 30-n. Referring to the drawing, there are shown two cases where the belt-shaped conductive foil 30 for grounding is divided. The conductive foils 30-1 . . . 3-n thus divided commonly connected to the lead 24b for grounding.

Figure 7B:
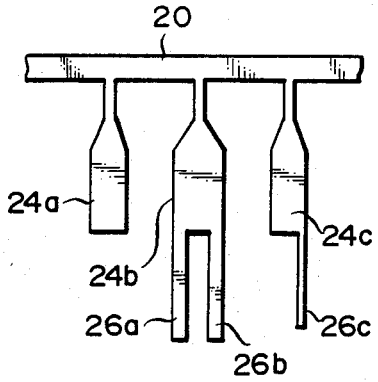

FIG. 7(B) shows an example of the lead frame 20 used in this noise filter. In this embodiment, a plurality of extensions 26a and 26b are provided on the lead 24b for grounding of this lead frame 20. Similarly, an extension 26c is provided on the lead 24c connected to the terminating end of the belt-shaped conductive foil 28 for passing the electricity.

The leads 26a and 26b which are provided on the lead 24b for grounding are connected to the split belt-shaped conductive foils 30-1, 30-2 in association therewith. With this arrangement, the impedance to a point of grounding is decreased, so that the noise filter can be greatly improved in high frequency attenuation characteristics.

The fourth embodiment

The foil-roll electronic parts according to the present invention can be widely used not only for the noise filters but also for other electronic parts.

Figure 8:
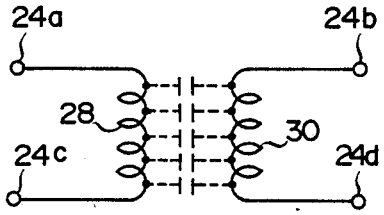
FIG. 8 then is an equivalent circuit diagram showing an example where a transformer having a primary and a secondary windings, which are independent from each other, is formed according to the present invention.
Figure 9:
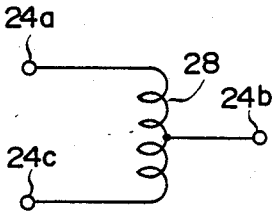
FIG. 9 is an equivalent circuit diagram showing an example of a coil having an intermediate tap and a transformer according to the present invention.

FIGS. 8 and 9 show examples where the foil-roll electronic parts according to the present invention are used in a transformer or a signal isolator.

More specifically, FIG. 8 shows an example of the transformer having the primary and secondary windings, which are independent of each other, and the construction thereof is identical with that of the noise filter shown in FIG. 6.

As apparent from this equivalent circuit diagram, the belt-shaped conductive foils 28 and 30 which are used as the primary and secondary wirings are magnetically, closely connected to each other, and moreover, capacitor-connected as well. Accordingly, the belt-shaped conductive foils 28 and 30 display highly stable signal transmitting characteristics over a wide band exceeding 100 MHz. Accordingly, when the foil-roll electronic part thus formed is used as shown in FIG. 8, it can be used as either a transformer or a signal connecting circuit between circuits different in potential from each other (isolator).

FIG. 9 shows an example of a coil with an intermediate tap and an auto-transformer, wherein a belt-shaped conductive foil 28 is rolled in through an insulating film. In this case also, the lead frame 20 is used, so that the leads 24a–24c can be lead-arranged in a straight line, and a transformer rendered compact in size and an inductor with an intermediate tap, which are high in yield, can be obtained. Furthermore, the part in this embodiment also uses the belt-shaped conductive foil 28, whereby this inductor is accompanied by relatively high parallel capacitances, so that the inductor can be used as an LC resonance circuit.

The fifth embodiment

Furthermore, in the present invention, the rolled-in belt-shaped conductive foil may be actively used as a portion of a transformer core.

Figure 10A:
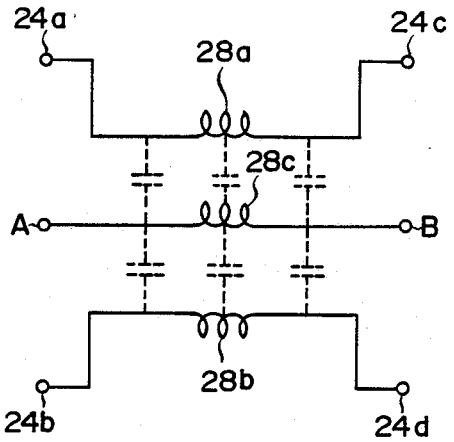
FIGS. 10 A, B and C are explanatory views of an example of the transformer according to the present invention, FIG. 10(A) being the equivalent circuit diagram thereof, FIG. 10(B) being an explanatory view showing the regulating member and FIG. 10(C) being an explanatory view showing a case where the circuit shown in FIG. 10(A) is grounded.

FIG. 10 shows an example of a transformer of this type.

This transformer is formed by rolling in at least three belt-shaped conductive foils 28a, 28b and 28c with insulating films thereinbetween. And, one foil 28c of the belt-shaped conductive foils is used as a portion of the transformer core, and the other two foils 28a and 28b of the belt-shaped conductive foils are used as the primary and secondary coils of the transformer, respectively. Both ends of each of the belt-shaped conductive foils 28a and 28b have leads connected thereto. Because of this, the number of leads used totals six including 24a–24d, A and B.

Figure 10B:
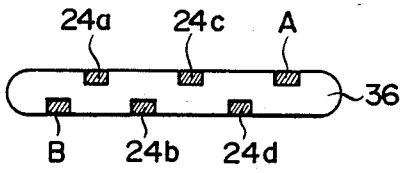

Furthermore, to form this transformer, it is preferable to use the regulating member 36 shown in FIG. 10(B). With this arrangement, a transformer with a magnetic core can be easily and reliably formed.

Figure 10C:
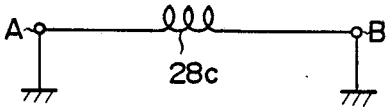
Figure 11A:
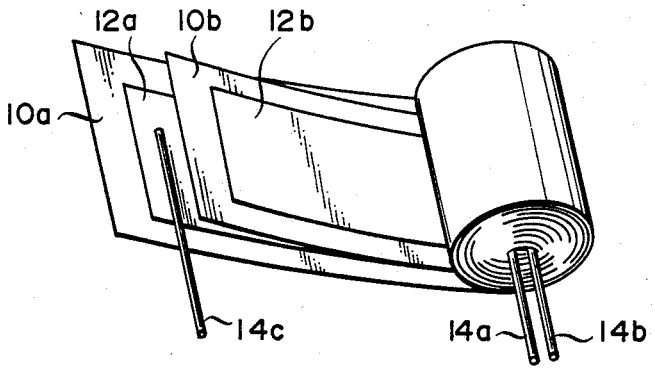
FIG. 11(A) (PRIOR ART)
FIG. 11 A and B are explanatory view of the conventional noise filter, FIG. 11(A) being an explanatory view showing the arrangement of the poise filter thereof and FIG. 11(B) being the equivalent circuit diagram of the conventional noise filter.
Figure 11B:
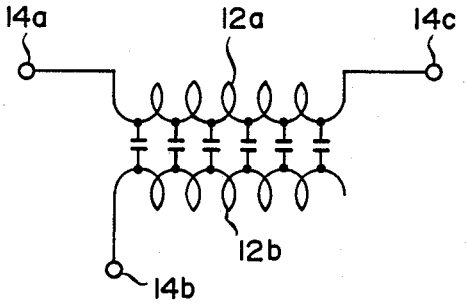
FIG. 11(B) (PRIOR ART)
Figure 12A:
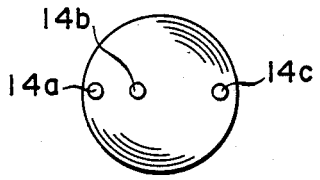
FIG. 12(A) (PRIOR ART)
FIGS. 12 A, B and C are explanatory views showing the leads' portion of the foil-roll electronic part, FIG. 12(A) being an explanatory view showing the ideal arrangement of the leads and FIGS. 12(B) and 12(C) being the explanatory views showing the conventional lead arrangements.
Figure 12B:
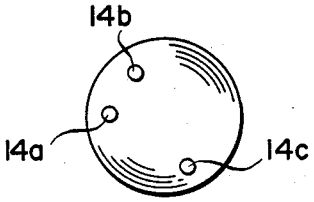
FIG. 12(B) (PRIOR ART)
Figure 12C:
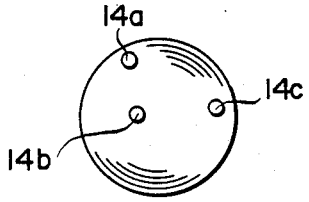
FIG. 12(C) (PRIOR ART

Furthermore, the belt-shaped conductive foil 28c used as a portion of the transformer core in the above-described transformer with the magnetic core is grounded at both ends thereof as shown in FIG. 10(C), so that noise can be reduced. Incidentally, the belt-shaped conductive foil 28c used in the above-described transformer core may be formed by use of a magnetic or a non-magnetic conductor.

In the foregoing, the foil-reel electronic part and the process of producing the same according to the present invention have been described, however, the present invention need not necessarily be limited to the above-described embodiments, and, needless to say, the present invention is applicable widely to the various LC composite parts using the belt-shaped conductive foil or foils and yet having three or more leads.

For example, the belt-shaped conductive foil and the insulating film are not separately formed, and the belt-shaped conductive foil may be integrally formed on the outer surface of a belt-shaped dielectric such as a metallized paper.

What is claimed is:

1. A process of producing a foil-roll electronic part having at least three leads, comprising the steps of:

forming a lead frame having at least three leads connected at ends on one side to a connecting member;

connecting one end of at least one belt-shaped conductive foil to at least one of the leads of said lead frame and engaging the leads of said lead frame with a regulating member;

inserting an insulating film adjacent a longitudinal surface of each of said at least one belt-shaped conductive foil;

rolling said at least one belt-shaped conductive foil and said insulating film using the regulating member as a spool;

bending an extension formed on the other lead than said at least one of the leads said bending connects said extension to a portion of said at least one belt-shaped conductive foil; and cutting off the connecting member from said at least three leads.

2. A process of producing a foil-roll electronic part having at least three leads, comprising the steps of:

forming a lead frame having at least two first leads, which are connected to at least one end thereof to a connecting member, and at least one second lead connected only at one end thereof to said connecting member;.

connecting one end of at least one belt-shaped conductive foil to at least one of said first leads and bending said second lead through a predetermined angle;

inserting an insulating film adjacent a longitudinal surface of each of said at least one belt-shaped conductive foil;

rolling said at least one belt-shaped conductive foil and said insulating film on the at least two first leads, returning the bent second lead to the substantially original position and connecting the second lead to a portion of said at least one belt-shaped conductive foil; and cutting off the connecting member from said at least three leads.

* * * * *